US009105459B1

(12) United States Patent
Floryan

(10) Patent No.: US 9,105,459 B1
(45) Date of Patent: Aug. 11, 2015

(54) MICROCHANNEL PLATE ASSEMBLY

(71) Applicant: Exelis Inc., McLean, VA (US)

(72) Inventor: Richard F. Floryan, Roanoke, VA (US)

(73) Assignee: Exelis Inc., McLean, VA (US)

( * ) Notice: Subject to any disclaimer, the term of this patent is extended or adjusted under 35 U.S.C. 154(b) by 116 days.

(21) Appl. No.: 13/839,164

(22) Filed: Mar. 15, 2013

(51) Int. Cl.

| | |
|---|---|
| ***H01J 43/00*** | (2006.01) |
| ***H01J 43/28*** | (2006.01) |
| ***H01J 43/24*** | (2006.01) |
| *H01J 43/04* | (2006.01) |

(52) U.S. Cl.
CPC ..... *H01J 43/28* (2013.01); *H01J 43/243* (2013.01); *H01J 43/246* (2013.01); *H01J 43/04* (2013.01)

(58) Field of Classification Search
CPC ..... H01J 43/04–43/28
USPC ..... 313/525, 528, 530, 532–534, 542–544, 313/103 R, 103 CM, 104–105 CM; 250/492.24, 214 VT, 207
See application file for complete search history.

(56) References Cited

U.S. PATENT DOCUMENTS

| | | | | |
|---|---|---|---|---|
| 5,265,327 | A * | 11/1993 | Faris et al. | 29/825 |
| 5,565,729 | A * | 10/1996 | Faris et al. | 313/103 CM |
| 6,087,649 | A * | 7/2000 | Estrera et al. | 250/214 VT |
| 7,129,464 | B2 * | 10/2006 | Buchin | 250/214 VT |
| 2004/0185742 | A1 * | 9/2004 | Iosue | 445/23 |
| 2006/0081770 | A1 * | 4/2006 | Buchin | 250/214 VT |
| 2009/0256063 | A1 * | 10/2009 | Sullivan et al. | 250/214 LA |
| 2010/0066245 | A1 * | 3/2010 | Van Spijker | 313/532 |
| 2014/0152168 | A1 * | 6/2014 | Suzuki et al. | 313/103 R |

* cited by examiner

*Primary Examiner* — Anne Hines
*Assistant Examiner* — Jose M Diaz
(74) *Attorney, Agent, or Firm* — Edell, Shapiro & Finnan LLC

(57) ABSTRACT

A microchannel plate assembly includes a plurality of microchannel plates that are aligned along a common axis and coupled together. The microchannel plates each have an object-side surface and an image-side surface and the assembly has respective interfaces between the image-side surface and the object-side surface of adjacent microchannel plates. At least one ion barrier film is disposed on at least one of the microchannel plates, but only on the object-side surfaces in the interfaces.

12 Claims, 3 Drawing Sheets

MICROCHANNEL PLATE ASSEMBLY

BACKGROUND

A microchannel plate (MCP) is a planar component used for detection of particles that cross the boundary of its surface to enter one of thousands if not millions of hollow channels distributed across the MCP. Each channel is an electron multiplier that produces an electrical current generated by the multiplication of electrons via secondary emission. The currents from respective channels of the MCP emerge as localized streams of electrons that, unlike other electron multipliers, retain a spatial distribution of the particle impingement patterns across its surface. For this reason, MCPs are widely used in image intensifiers.

In a typical image intensifier configuration, a photocathode, an assembly of one or more MCPs, and a cathodoluminescent element, such as a phosphor screen, are enclosed within a vacuum. An electron is generated from an impinging photon by the photocathode and is multiplied by the MCPs, and the electrons that emerge from the MCPs are converted into photons by the phosphor screen. The photocathode is constructed from a wavelength-selective material, typically in a very thin layer, that is exposed in the chamber of the device. A major drawback of these types of image intensifying devices is that the electrostatic fields that transport the electrons from the photocathode coating to the MCP assembly also transport positive ions generated in the electron multiplication back towards the photocathode. Because these positive ions may have considerable mass, irreparable damage is done when such an ion strikes the photocathode. Efforts to mitigate this ionic transport are ongoing in the MCP field.

Depositing a thin ion barrier film (IBF) on the input side of the MCP is a conventional technique by which ions are prohibited from reaching the photocathode. There are several drawbacks to the use of the ion barrier film, one of which is a reduction in the signal-to-noise ratio (SNR) owing to absorption of electrons by the ion barrier film. Another drawback is the formation of a halo around objects in the image due to photoelectrons being incapable of initially penetrating the IBF and instead bouncing to another location and penetrating there. Yet another drawback is that higher voltage must be applied between the photocathode and the MCP in order to overcome the electron barrier established by the IBF.

Despite the recognized advantages of using ion barrier films, particularly where the useable lifetime of the photocathode is extended, poor imaging performance continues to frustrate consumers and designers alike.

SUMMARY

Described herein is microchannel plate assembly incorporating a particular IBF arrangement to mitigate recognized performance shortcomings in the art. A plurality of microchannel plates are aligned along a common axis and coupled together in an assembly. The microchannel plates each have an object-side surface and an image-side surface and the assembly has respective interfaces between the image-side surface and the object-side surface of adjacent microchannel plates. An ion barrier film is disposed on one of the object side surfaces in the interfaces.

DETAILED DESCRIPTION

Figure 1:
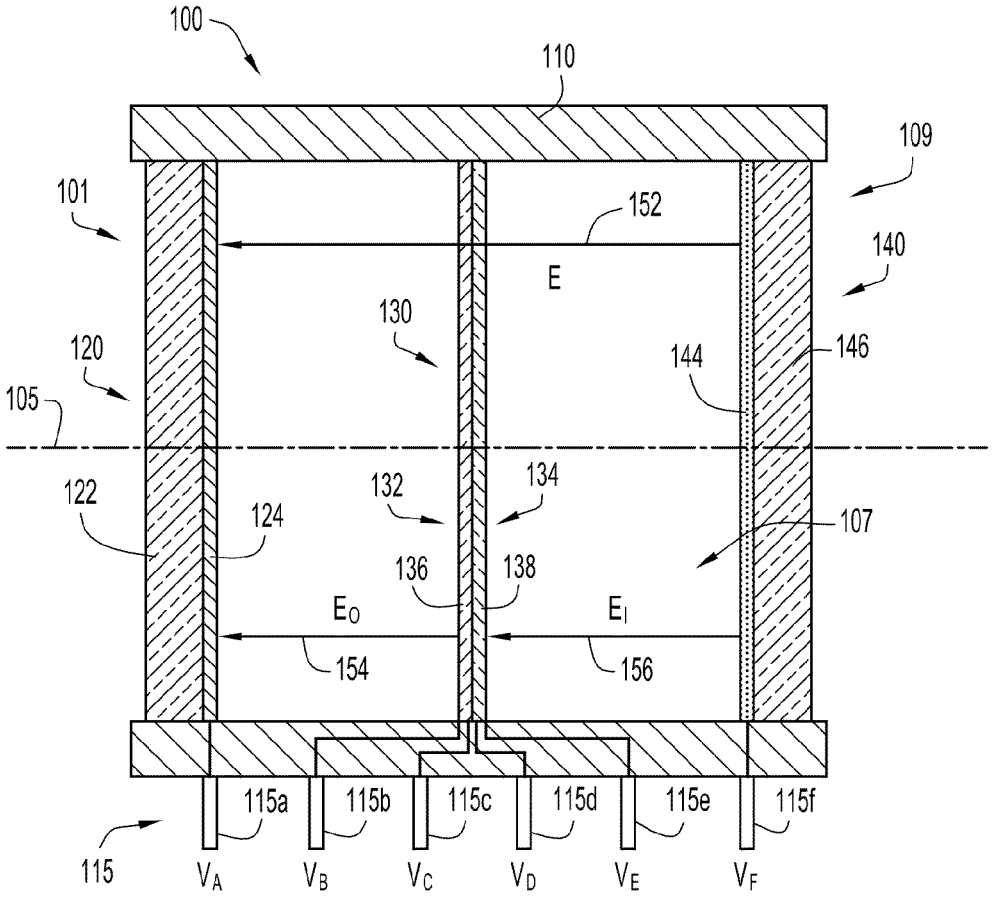
FIG. 1 is a diagram illustrating an image intensifier tube in which the present general inventive concept may be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments. Particular quality or fitness of the examples indicated herein as exemplary is neither intended nor should be inferred.

FIG. 1 is schematic diagram of an exemplary image intensifier tube (I2T) 100 in which the present invention may be embodied. Briefly, I2T 100 is constructed from a housing 110, a photocathode element 120, a microchannel plate (MCP) assembly 130 and cathodoluminescent (CL) element (CLE) 140. Photocathode element 120, MCP assembly 130 and CLE 140 are aligned on an optical axis 105 and relatively spaced apart so as to be in proximity focus with the adjacent element in the electron path. For purposes of orientation, I2T 100 has an object side 101 at which photons are accepted, and an image side 109 at which photons are emitted. By this defined geometry, photocathode element 120 is located at the object side 101 of image intensifier 100 and CLE 140 is located at the image side 109. MCP assembly 130 thus also has an object side 132 at a surface of object-side MCP 136 and an image side 134 at a surface of image-side MCP 138. The interior of I2T 100 is evacuated to form a vacuum chamber 107 of about $10^{-9}$ to $10^{-10}$ Torr to protect the photocathode from oxidation and rapid destruction.

Photocathode element 120 may be constructed from an optical window 122 and a photocathode 124 disposed on window 122. Optical window 122 may be an optical flat of a material that is optically transmissive to photons having wavelengths of interest and for which I2T 100 is designed to detect. Photocathode 124 is a very thin, light-sensitive layer deposited on the inside of window 122 that converts impinging photons into electrons and releases them into the vacuum of the tube. In certain embodiments, photocathode 124 is formed from gallium arsenide (GaAs) bulk material with a negative electron affinity activation layer, such as cesium oxide (CsO). However, the CsO layer is fragile and can be severely damaged by ions fed back by to photocathode 124 by electric field 154. While embodiments of the present invention ameliorate this issue, the present invention is not limited to a particular photocathode element 120.

CLE 140 may have an optical window 146 constructed of a material that is optically transmissive at wavelengths matching the CL material, e.g., phosphor, in layer 144. CL layer 144 may have additional materials such as aluminum and forms the anode of I2T 100.

MCP assembly 130, which is described in detail with reference to FIG. 2, may be disposed in vacuum chamber 107 in an electric field 152 generated between photocathode 124 and anode 142. While electric field 152 is illustrated as being continuous, it may be formed piecewise by apply voltages $V_A$-$V_E$ at terminals 115 and may be discontinuous at MCP assembly 130. In the illustrated embodiment, electric field 152 is a sum of object-side electric field 154 and image-side electric field 156, which may be separately generated by applying suitable potential differences between terminals 115*a* and 115*b*, and 115*e* and 115*f*, respectively. The net effect of the electric fields 154 and 156 is to drive electrons from photocathode element 120 towards CLE 140.

In operation, photons of an input wavelength enter the tube through window 122 and strike photocathode 124 to generate photoelectrons. The photoelectrons are accelerated by electric field 154 towards MCP assembly 130 where they are multiplied by cascaded secondary emission. For each electron that enters MCP assembly 130, hundreds of electrons are generated. The generated electrons emerge from MCP assembly 130 in localized groups at the exit aperture of each microchannel, where they are accelerated by electric field 156 towards CLE 140. The MCP assembly 130 and CLE 140 are spaced in proximity focus so that the localized groups of electrons arrive at the phosphor coating layer 144 with minimal dispersion. At CLE 140, the electrons are converted into photons of an output wavelength by the material in CL layer 144. For every photon striking photocathode 124, tens of thousands of photons are generated by CLE 140, thus "intensifying" the original image.

Figure 2:
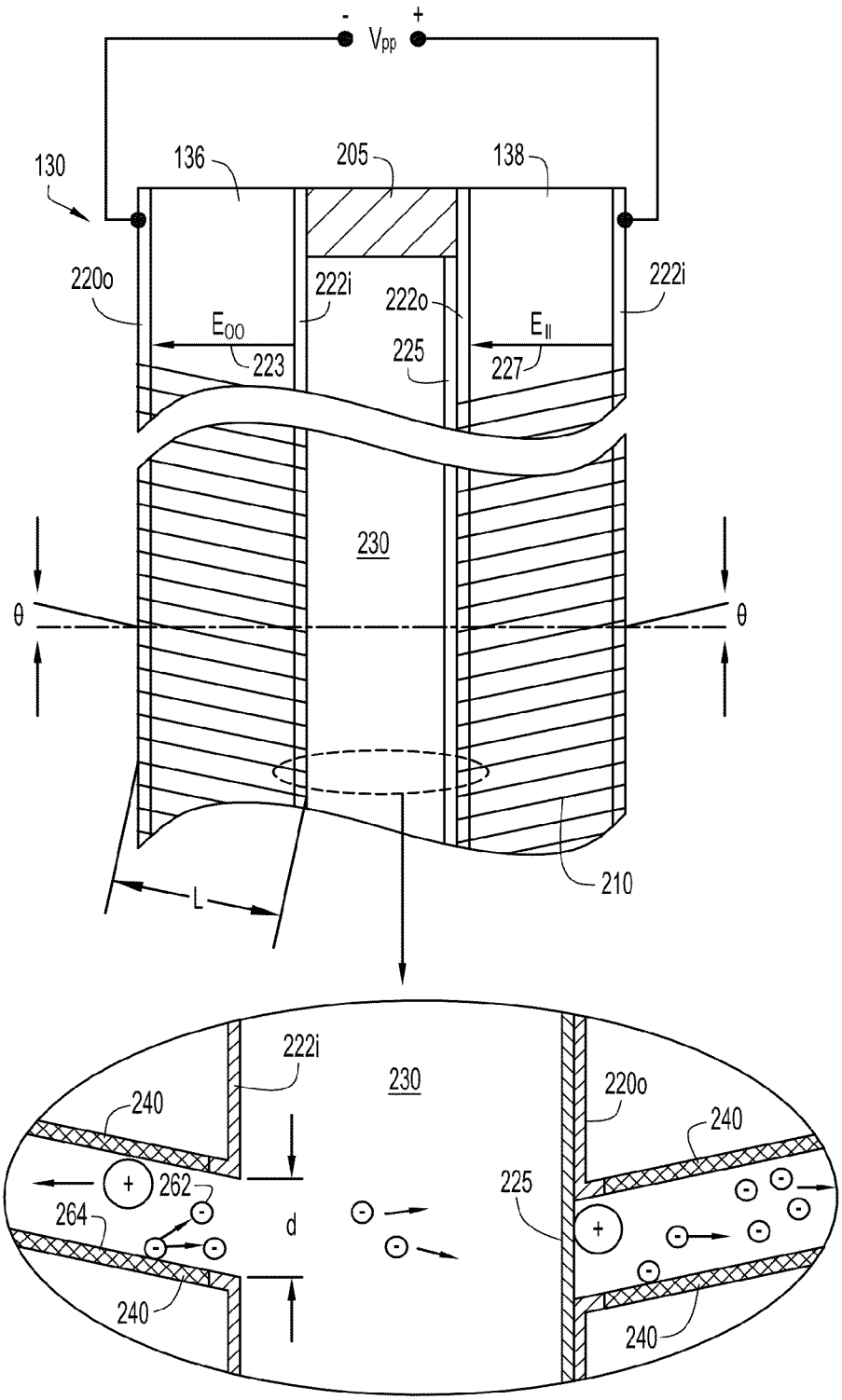
FIG. 2 is a diagram illustrating details of a multichannel plate assembly in which the present general inventive concept may be embodied.

As illustrated in FIG. 2, MCP assembly 130 is constructed from object-side MCP 136 and image-side MCP 138 separated by a spacer 205. Each microchannel plate 136, 138 may be manufactured from a highly resistive material of, for example, 2 mm thickness. A regular array of densely-distributed tiny tubes or slots, i.e., the microchannels 210, traverse the thickness of the microchannel plate 136, 138 from one face to the opposite. The diameter d of microchannel 210 may be approximately 5 micrometers and the microchannels 210 may spaced apart at approximately 6 micrometers intervals. Microchannels 210 may be parallel to one other and may be formed in the plate at a small angle θ with respect to the optical axis 105, e.g., approximately 3°-5°. The length-to-diameter ratio L/d, the material in the channel walls and the electric field strength across the microchannel establish the electron gain of the MCP. In certain embodiments, microchannels 210 have an L/d of between 60 to 70.

The object-side and image-side surfaces of MCP 136, 138 may be suitably coated with a metal electrode layer 222*o* and 222*i*, respectively, such as NICHROME, although the present invention is not so limited. Electrode layers 222*o* and 222*i* may be deposited by evaporation to uniformly penetrate into microchannels 210. This penetration, referred to as end-spoiling, affects the angular distribution and kinetic energy of exiting electrons. In certain embodiments, the penetration depth is approximately 0.5-3.5 times the diameter d of microchannel 210, with deeper penetrations providing higher collimation of the exiting electron groups. Additionally, in certain embodiments, spacer 205 is conductive and serves as an electrical connection between facing electrode layers 222*o*, 222*i* in the interfaces. When so embodied, a single potential difference Vpp may be applied to the outermost electrode layers 222*o*, 222*i* by which electrical fields 223 and 227 are generated and terminate on the conductive boundaries of the inner electrode layers 222*o*, 222*i*. Accordingly, the electric field in the interface region 230 is zero.

The interior surface of channel 210 may have a high secondary electron emission coefficient from lead/alkali content in the glass fibers from which MCP 136, 138 are manufactured. A firing procedure may be used to bring this content to the surface and this surface layer is electrically connected to the object-side electrode 222*o* and image-side electrodes 222*i* of each MCP 136, 138 to form an independent, continuous-dynode electron multiplier, in which electron multiplication takes place under the presence of a strong electric field 233 or 237. The angle θ is established to increase the likelihood that an electron moving in a direction roughly parallel with optical axis 105, i.e., the direction of the electric field, will strike the wall of one of the microchannels 210. Such impact initiates cascaded secondary emissions of electrons, whereby the number of electrons increases exponentially along the length L of microchannel 210.

The dual MCPs 136 and 138 of MCP assembly 130 can have an order of magnitude greater gain than a single MCP if both MCPs were operated at their typical single plate voltage levels. An electron arriving at object-side MCP 136 enters microchannel 210 and, upon striking layer 240, initiates cascaded secondary emissions under electric field 233. The multiplied electrons 242 emerge from the image side of object-side MCP 136 and enter the inter-plate interface 230 When the electric field in interface 230 is zero, the electrons from MCP 136 traverse the interface by way of kinetic energy. The electrons 242 enter microchannels 210 of image-side MCP 138 and initiate additional cascaded secondary emissions therein. These multiplied electrons then emerge from image side of MCP 138 and are directed toward CLE 140.

An unavoidable consequence of such cascaded secondary emissions is the desorption of ions in microchannels 210. The electric fields 233 and 237, respectively, accelerate these positive ions toward the object side of MCPs 136 and 138, respectively. If these ions are allowed to escape and come under the influence of electric field 154, they are accelerated toward and strike photocathode 124, causing irreversible damage to the CsO activation layer, thereby reducing its photo-responsiveness and shortening the lifespan of the device. Alternating the angular directions of microchannels 210 into the illustrated "chevron" condition is one measure that is taken to impede the progression of ions into electric field 154. In addition, embodiments of the invention employ an ion barrier film (IBF) 225 over the object-side surface of image-side MCP 138. In certain embodiments, IBF 225 is 0.5-0.10 nm aluminum oxide $Al_2O_3$ layer deposited over the object-side surface of MCP 138 in a manner by which the layer covers the input apertures of microchannels 210 on this surface. $Al_2O_3$ is minimally penetrable by ions and maximally penetrable by electrons, has high mechanical strength and is chemically stable. Other materials and structures, including multilayer structures may be used in IBF 225 without departing from the spirit and intended scope of the present invention.

In accordance with the present invention, object-side MCP 136 is filmless, i.e., free of an IBF. The application of an IBF to the MCP introduces a scattering center for impinging electrons. Introducing this scattering center at the object side, where only photoelectrons from photocathode 124 are present significantly reduces image quality. When the IBF is behind the object-side MCP, the backscattered electrons from the surface of the IBF are completely captured by the image-side surface of the object-side MCP 136, since there is no electric field in interface region 230 to accelerate the electrons to the object-side surface of image-side MCP 138. Moreover, without an IBF on the outermost object-side surface, a 30-50% less intense electric field across MCP 136 can produce approximately the same electron gain as that achieved with the IBF on the outermost object-side surface at full electric field strength. Alternatively, a full strength electric field would allow increasing the distance between photocathode 124 and object-side MCP 136, which reduce field effect artifacts in the resulting image. And, while ions from object-side MCP 136 may still escape into electric field 154, these ions are in number far less than the number of ions generated in image-side MCP 138 and depositing IBF on the image-side MCP 138 thus serves to greater effect, particularly in light of image quality achieved by keeping the object-side MCP 136 barrier free.

Figure 3:
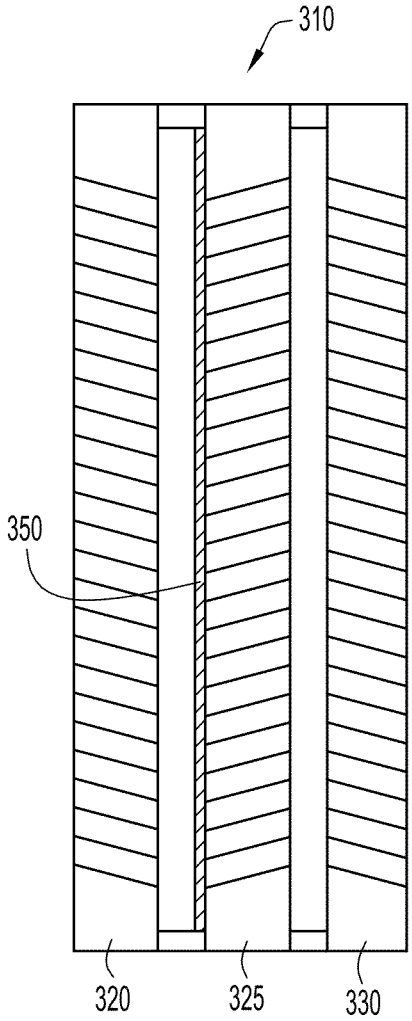
FIG. 3 is a diagram illustrating another configuration of a multichannel plate assembly in which the present general inventive concept can be embodied.

FIG. 3 is an illustration of a three plate MCP assembly, a so-called "Z-stack" by which the present invention can be embodied. MCP assembly 410 comprises an object-side MCP 420, and image-side MCP 430 and an intermediate MCP 425. The MCPs 420, 425 and 430 may be constructed in a manner described above. However, in MCP assembly 410, only intermediate MCP 425 has an IBF 450 disposed on its object-side surface. In configuration 340, IBF 350 is disposed on both intermediate MCP 425 and image-side MCP 430. In both of these cases, object-side MCP 420 remains barrier free. Other configurations may be implemented in accordance with the present invention without departing from the spirit and intended scope thereof.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. An apparatus comprising:

a plurality of microchannel plates including an object-side microchannel plate and an image-side microchannel plate, the microchannel plates being aligned along a common axis and being mechanically coupled to form respective interfaces between an image-side surface that faces an object-side surface of an adjacent one of the microchannel plates; and at least one ion barrier film disposed on the object-side surface of any of the microchannel plates excluding the object-side microchannel plate.

2. The apparatus of claim 1, wherein the microchannel plates are exactly two (2) in number.

3. The apparatus of claim 1, wherein the microchannel plates are exactly three (3) in number and an intermediate microchannel plate is interposed between the object-side microchannel plate and the image-side microchannel plate.

4. The apparatus of claim 3, wherein the ion barrier film is disposed on the object-side surface of only the intermediate microchannel plate.

5. The apparatus of claim 1 further comprising:

a photocathode element having an optical axis aligned with the common axis of the microchannel plates;

a cathodoluminescent element having another optical axis aligned with the common axis of the microchannel plates; and a housing mechanically supporting the photocathode at an object end thereof, the cathodoluminescent element at an image end thereof, and the microchannel plates interposed between the photocathode element and the cathodoluminescent element such that the object-side microchannel plate is proximal to the photocathode element and an image-side microchannel plate is proximal to the cathodoluminescent element.

6. The apparatus of claim 5 further comprising:

electrode coatings on the image-side surface and the object-side surface of the respective multichannel plates; and a set of terminals exterior to the housing and in electrical continuity with the electrode coatings of the object-side microchannel plate and the image-side microchannel plate to establish an electric field across the microchannel plates.

7. The apparatus of claim 6, wherein the electrode coatings on adjacent surfaces in the interfaces are electrically connected.

8. An apparatus comprising:

a microchannel plate assembly having an object-side surface and an image-side surface to generate spatially distributed output electron streams from likewise spatially distributed input electrons, the microchannel plate assembly comprising:

a plurality of microchannel plates including an object-side microchannel plate and an image-side microchannel plate, the microchannel plates being aligned along a common axis and being mechanically coupled to form respective interfaces between an image-side surface that faces an object-side surface of an adjacent one of the microchannel plates; and at least one ion barrier film disposed on the object-side surface of any of the microchannel plates excluding the object-side microchannel plate;

an input device to generate the input electrons in response to a physical stimulus, the input device having an optical axis aligned with the common axis of the microchannel plate assembly; and an output device to generate a human perceivable signal from the output electron streams.

9. The apparatus of claim 8, wherein the microchannel plates are exactly two (2) in number.

10. The apparatus of claim 8 wherein the microchannel plates are exactly three (3) in number and the microchannel plate assembly includes an intermediate microchannel plate interposed between the object-side microchannel plate and the image-side microchannel plate.

11. The apparatus of claim 10, wherein the ion barrier film is disposed only on the object-side surface of the intermediate microchannel plate.

12. The apparatus of claim 8, wherein the input device is a photocathode element and the output device is cathodoluminescent element and further comprising:

a housing mechanically supporting the photocathode at an object end thereof, the cathodoluminescent element at an image end thereof, and the microchannel plate assembly interposed between the photocathode element and the cathodoluminescent element to have the object-side the microchannel plate assembly closest to the photocathode element and the image side of the microchannel plate assembly closest to the cathodoluminescent element.

* * * * *